United States Patent [19]

Gröner

[11] Patent Number: 4,759,640

[45] Date of Patent: Jul. 26, 1988

[54] ROSE-BOTTOM OR BLOCK-BOTTOM VALVE BAG

[75] Inventor: Alois Gröner, Lengerich, Fed. Rep. of Germany

[73] Assignee: Bischof und Klein GmbH & Co., Lengerich, Fed. Rep. of Germany

[21] Appl. No.: 16,043

[22] Filed: Feb. 18, 1987

[30] Foreign Application Priority Data

Oct. 24, 1986 [DE] Fed. Rep. of Germany ... 8628387[U]

[51] Int. Cl.[4] ..... B65D 30/24

[52] U.S. Cl. ..... 383/44; 383/46; 383/54

[58] Field of Search ..... 383/48, 44, 46, 49, 383/50, 51, 52, 53, 54, 55, 56, 57, 58, 93, 94, 100, 121

[56] References Cited

U.S. PATENT DOCUMENTS

| | | | |
|---|---|---|---|
| 3,081,930 | 3/1963 | Owens | 383/53 |
| 4,049,191 | 9/1977 | Stearley | 383/54 |
| 4,095,736 | 6/1978 | Rothchild, III et al. | 383/46 |

FOREIGN PATENT DOCUMENTS

| | | | |
|---|---|---|---|
| 138826 | 1/1953 | Switzerland | 383/46 |
| 955630 | 4/1964 | United Kingdom | 383/51 |

*Primary Examiner*—Willis Little

*Attorney, Agent, or Firm*—Jordan and Hamburg

[57] ABSTRACT

A bag of foldable material has an end closure closing off one end of the bag and a filling valve tube device extends into the end closure at a corner of the bag, the filling valve tube device has an inner end disposed within the interior of the bag and has an inner layer which is convertable from a normally inactive adhesive state to a state capable of sealing off the filling valve tube device. A shut-off lip device of flexible material is disposed within the end closure and projects into the interior of the bag beyond the interior end of the filling valve tube device, the shut-off lip device being constructed to be responsive to the pressure of the filling material introduced into the interior of the bag to close off the interior opening of the filling valve tube device.

24 Claims, 2 Drawing Sheets

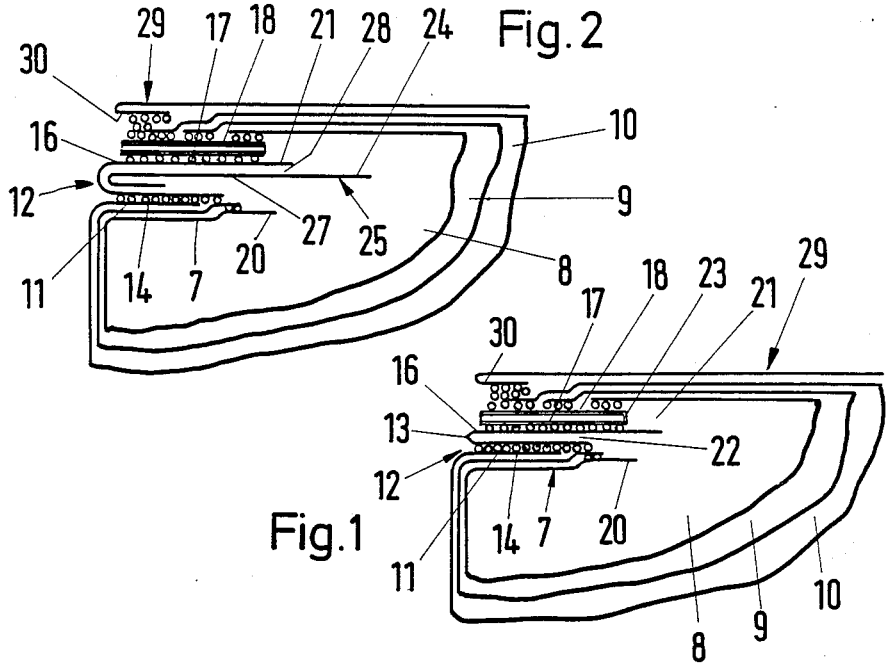
Fig. 2
Fig. 1
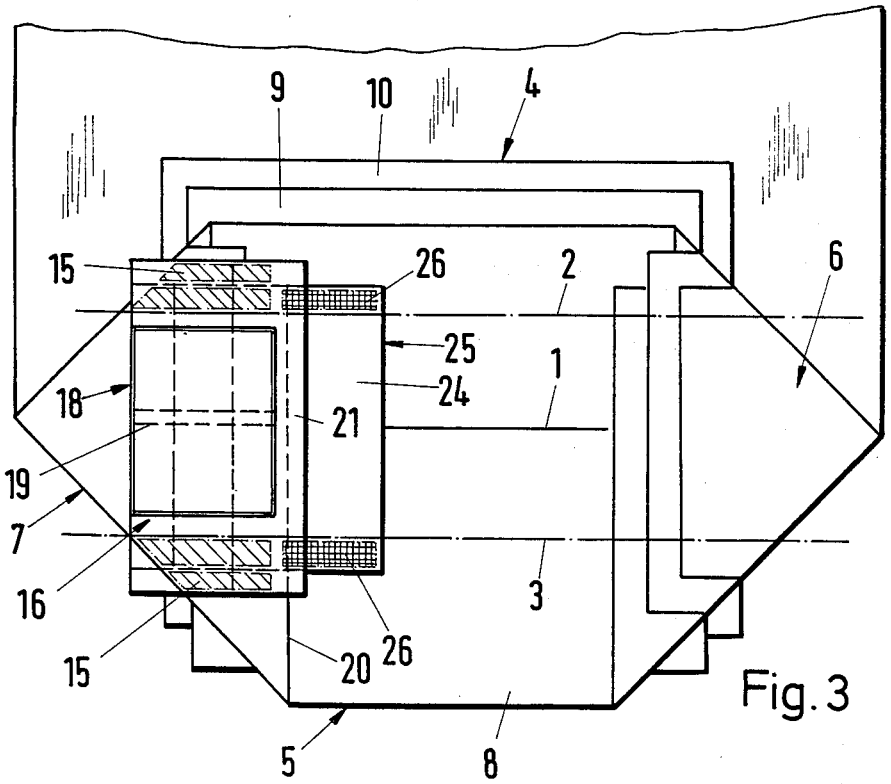
Fig. 3

ROSE-BOTTOM OR BLOCK-BOTTOM VALVE BAG

The invention relates to a rose-bottom or block-bottom valve bag or the like foldable material, having a filling valve which is incorporated in one of its two ends bounded laterally by lateral fold lines of the end, in the region of a corner turn-in forming a valve and which is formed from a valve tube with an inner layer which can be converted from a normally inactive adhesive state into a state capable of adhesion or sealing for a hermetic sealing of the valve tube.

Valve bags of this known type are filled with a material capable of trickling or being poured, by means of automatic filling machines, the valve tube of the bag being pushed over the filling nozzle of the filling machine. The inner layer of the valve tube permits this in its normally inactive adhesive state. After termination of the filling operation, the inner layer of the valve tube is converted into an active ahdesive state so that the valve tube can be stuck together flat, using pressure, and so forms a dustproof sealing of the valve passage defined by the valve tube. In this case, the inner layer of the valve tube is usually constructed in the form of a thermoplastic inner coating on a layer of paper forming the valve tube and is reactivated, that is to say converted into a state capable of adhesion or sealing, by the supply of heat, for example by means of a hot air blower.

It is frequently found, however, that this closure of the valve passage cannot be carried out properly because of internal contamination of the valve tube with residues of filling material. This is primarily attributable to the fact that when the filled bag is thrown down from the filling machine during the positioning of the bag in the apparatus for closing the valve tube, small amounts of filling material trickle out of the interior of the bag and can enter the valve passage. Here they then prevent adhesion or melting over the whole area of the two halves of the valve tube laid flat under pressure after reactivation of the inner layer.

It is the object of the invention to provide a rose-bottom or block-bottom valve bag wherein the penetration of particles of filling material into the valve tube after termination of the filling operation is reliably avoided so as to be able to produce a proper, dustproof closure of the valve tube after reactivation of its inner layer.

Starting from a rose-bottom or block-bottom valve bag of the type indicated at the beginning, this problem is solved, according to the invention, in that a shut-off lip of flexible material of at least the width of the valve tube projects beyond the valve tube at its under side at its end adjacent to the interior of the bag, which lip can be moved automatically into a shut-off position sealing the inner opening of the valve tube under pressure of the material with which the interior of the bag is filled. The inner shut-off lip provided, according to the invention, in addition to the valve tube reliably seals the valve tube, at its end adjacent to the interior of the bag filled with material, against small amounts of filling material trickling out at least to such an extent that the following internal closing of the valve tube by means of its inner layer converted into the state capable of adhesion or sealing is not impaired.

In a further development of the invention, the shut-off lip may be formed from an end portion, projecting freely into the interior of the bag, of an insert sheet located by a lower region on the corner turn-in forming the valve and carrying the valve tube in an upper region, which sheet has a width exceeding the width of the end of the bag and is fixed at the edges by connection to the lateral turn-overs of the end in its lower component regions situated outside the lateral fold lines of the end. In this case, the position of the shut-off lip is defined in relation to the opening leading into the interior of the bag and under the pressure of the filling material introduced, a correspondingly predetermined movement of the shut-off lip into contact with the inner opening of the valve tube is effected in order to prevent the filling material from trickling out.

Depending on the filling conditions and the nature of the filling material, a further development of the valve bag according to the invention may be recommended wherein a separate sealing lip projects beyond the shut-off lip towards the interior of the bag. In this manner, the blocking section against filling material trickling out can be further improved.

Fundamentally, any suitable soft flexible materials, such as plastics sheets, thin paper, fibre fleece and the like in particular, may be considered for the shut-off lip and the sealing lip. In those forms of embodiment of the invention wherein the separate inner sealing lip is provided in addition to the shut-off lip, a sealing lip of a more flexible material than the shut-off lip is advisable, for example of a thin plastics film in which case the shut-off lip may appropriately be formed from a somewhat stiffer material, for example paper.

The construction according to the invention not only renders possible transverse dimensions of the valve tube corresponding to the width of the end of the bag but also easily permits smaller transverse dimensions of the valve tube for adaptation of the valve passage to the predetermined diameter of the filling nozzle of the automatic filling machine of the packaging factory.

Embodiments of the present invention will now be described, by way of example, with reference to the accompanying drawings, in which:

FIG. 1 shows a broken-away vertical section through the valve corner of a finished, rose bottom according to a first example of embodiment of the invention;

FIG. 2 is an illustration corresponding to FIG. 1 to illustrate a further example of embodiment of the invention;

FIG. 3 shows a plan view of the end of a bag workpiece pulled open to form an open rose bottom to illustrate the form of valve according to FIG. 2;

Figure 4:
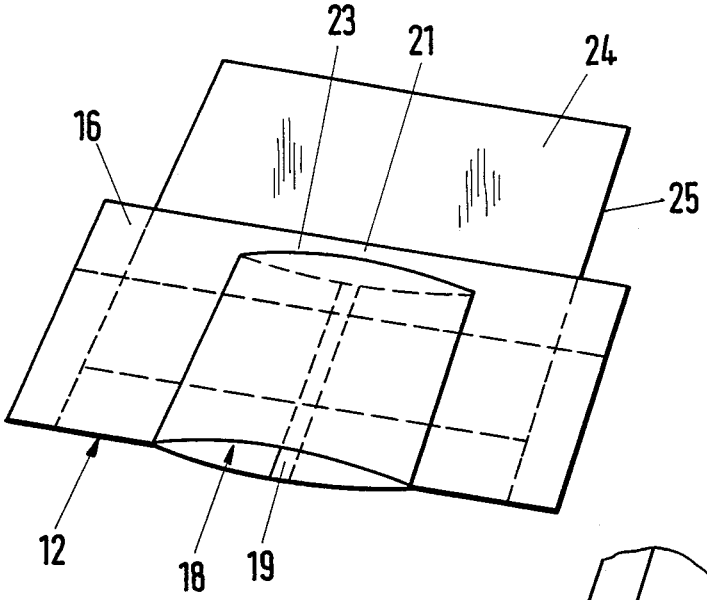
FIG. 4 shows a perspective illustration of the individual parts of the valve shown in FIG. 3.

In the embodiments illustrated in the drawings, a three-layer rose-bottom valve bag of paper is shown, which may also be replaced by a rose-bottom valve bag of one or two layers of material or any other suitable number of layers. Instead of layers of material consisting entirely of paper, layers of material with paper may also be used, for example paper laminated with plastics sheet and/or metal foil, or intermediate layers of metal foil, plastics sheet and the like materials. When the rose bottom is produced by the adhesion of material, the sides or layers of material consisting of paper are preferably used, and permit the use of adhesives on a starch basis usual in the production of paper bags. A rose bottom bag may be replaced by a block bottom bag which differs from a rose bottom bag by the inserted lateral folds and the ends which are already rectangular in the unfilled state of the bag. Plastics sheets alone may also be considered as bag material.

In the examples illustrated, in FIG. 3 showing the rose bottom in the still open state, that is to say not yet in the finished, closed state, the break line in the middle of the end is designated by 1 while the two lateral fold lines of the end are each illustrated in chain line at 2 and 3. The two lateral turn-overs of the open rose bottom are designated by 4 and 5 respectively and the two corner turn-ins by 6 and 7. The three layers of material arranged concentrically with one another are designated by 8, 9 and 10 and are staggered at the end in a manner known per se, while furthermore, the layers of material are provided with incisions to lengthen the lateral turn-overs 4 and 5 of the end in the longitudinal direction of the end.

The corner turn-in 7 is the valve-forming corner turn-in to which an insert sheet 12 of paper is stuck by means of an application of adhesive 11 (FIGS. 1 and 2) to produce a filling valve. The insert sheet 12 has a turn-over with a fold edge 13 directed towards the outside of the bag, the lower portion 14 of the turn-over being stuck to the corner turn-in 7 by means of the application of adhesive 11. The width of the insert sheet 12 exceeds the width of the finished end of the bag which is defined by the transverse dimension between the lateral fold lines 2 and 3 of the end. In its component regions situated outside the lateral fold lines 2, 3 of the end, the turn-over portion 14 is connected to the lateral turn-overs of the end 4 and 5 by applications of adhesive 15 (FIG. 3) and so located at the edges.

Figure 5:
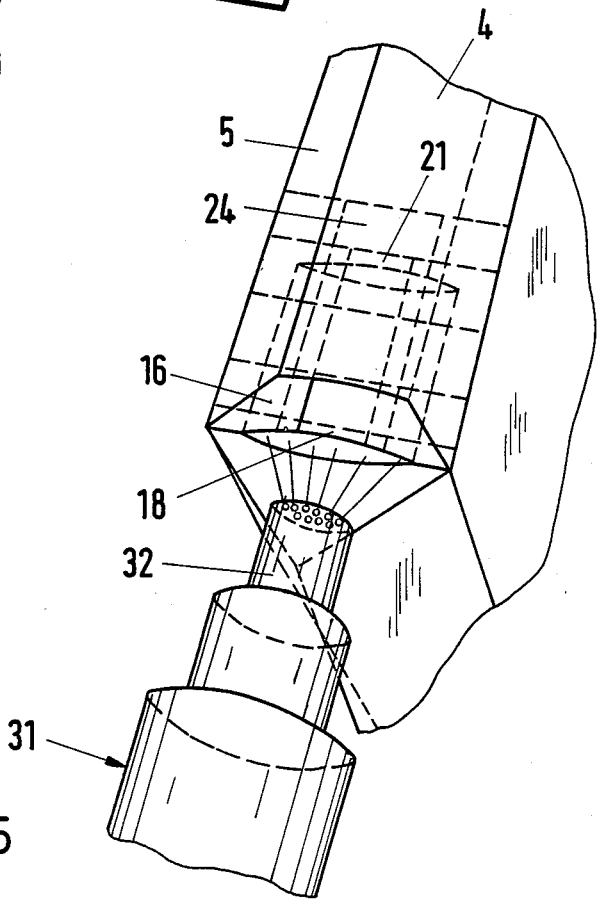
FIG. 5 shows a perspective illustration of the valve corner region of a filled rose bottom bag together with a hot air blower to reactivate the internal coating of the valve tube.

Stuck to the upper turn-over portion 16 of the insert sheet 12 by means of an application of adhesive 17 (FIGS. 1 and 2) is a valve tube 18, the width or transverse dimension of which is smaller than the width of the end of the bag, as FIGS. 3 to 5 show in particular. The valve tube 18 consists of a layer of paper which is formed into a tube by means of a longitudinal seam 19 and has an internal coating of a thermoplastic material which is normally, that is to say particularly at room temperature, inactive as an adhesive but can be converted into a state capable of adhesion or sealing by the supply of hot air in order to close the valve tube over an area while it is being pressed flat. The width of the valve 18 is selected in accordance with the given diameter of the filling nozzle of a filling machine.

Whereas the lower turn-over portion 14 ends, at its end adjacent to the interior of the bag, before the inner edge 20 of the corner turn-in 7, the upper turn-over portion 16 is taken beyond the inner edge 20 of the corner turn-in 7 towards the interior of the bag and furthermore projects beyond the valve tube 18 by a short distance of about 15 to 20 mm at its end adjacent to the interior of the bag. This component portion of the upper turn-over portion 16 projecting beyond the valve tube 18 towards the interior of the bag forms a shut-off lip 21 which can be moved automatically into a shut-off position sealing the inner opening of the valve tube 18 under the pressure of the filling material introduced into the interior of the bag.

This movement of the shut-off lip 21, which is directed upwards according to the illustration in FIG. 1, into its closing position in front of the inner opening of the valve tube, is encouraged by the fact that the two turn-over portions 14 and 16 of the insert sheet 12 form a pocket 22 opening towards the interior of the bag. The pocket 22 can be expanded by filling material penetrating into the pocket 22 with the result that the upper turn-over portion 16 moves upwards and accordingly the sealing lip 21 bears against the inner opening of the valve tube, the edge 23 of which acts as an abutment.

In the example of embodiment shown in FIGS. 2 to 5, a sealing lip 24, which projects beyond the shut-off lip 21 towards the interior of the bag, is provided in addition to the shut-off lip 21 formed by the insert sheet 12. The sealing lip 24 is formed from an end portion of a blank 25 of plastics sheet for example, which end portion projects freely into the interior of the bag and the width of which exceeds the width of the end of the bag. In its component regions situated ouside the lateral fold lines 2 and 3 of the end of the bag, the blank 25 is stuck to the lateral turn-overs 4 and 5 of the end of the bag by means of applications of adhesive 26 (FIG. 3) and so fixed at the edges like the insert sheet 12. The blank 25 is loosely enclosed, by its end portion directed towards the outside of the bag and provided with a turn-over, in the turn-over of the insert sheet 12, that it to say there are no adhesive connections between the blank 25 and the insert sheet 12 in the region of the width of the end of the bag. The upper or main portion 27 of the blank 25 forms, with the upper turn-over portion 16 of the insert sheet 12, a pocket 28 which is open towards and leads into the interior of the bag and which, like the pocket 22, can be expanded by penetrating filling material in such a manner that the movement of the shut-off lip 21 into contact with the inner opening of the valve tube is additionally reinforced. Altogether, the movement both of the shut-off lip 21 and of the sealing lip 24 into contact with the inner opening of the valve tube is predetermined by the expanding movement of the pocket 22 under the action of the filling material introduced.

In FIGS. 1 and 2, an end cover sheet 29, which is stuck onto the finished, closed rose bottom at the outside, is illustrated with a turn-over 30 at the valve corner, which covers and strengthens the outer region of the valve and particularly of the valve tube 18.

In the form of embodiment shown in FIG. 5, such an end cover sheet is not provided. In this case, the reinforcement of the valve in its outer marginal region is taken over by the lateral turn-overs 4 and 5 of the end of the bag which are provided in a manner known per se with incisions arranged parallel to the axis of the bag tube and cause a lengthening of the lateral turn-overs 4, 5 in the longitudinal direction of the end of the bag, that is to say outwards towards the corners of the bag.

Further illustrated in FIG. 5 is a hot-air blower 31 of an apparatus for closing the filled bags. Jets of hot air are directed from the nozzle 32 of the hot-air blower 31 onto the inner coating of the slightly open valve tube 18, in order to convert its inner coating into the state in which it is capable of adhesion or sealing so that the inner valve passage defined by the valve tube 18 can be closed over the whole area in a dustproof manner with the valve tube 18 being pressed flat.

The mutual correlation of the insert sheet 12, of the valve tube 18 and of the sealing material blank 25, which can be seen in FIG. 5, results on folding inwards, with adhesion, of the lateral turn-overs 4 and 5 of the end about the lateral fold lines 2, 3 of the end, out of the position shown in FIGS. 3 and 4, the regions of the insert sheet 12 and of the sealing material blank 25 situated outside the lateral fold lines 2 and 3 being also folded over at the same time.

It will be understood that in the sectional illustrations the spacing of the layers is shown exaggerated in the interests of a clear illustration.

I claim:

1. A bag comprising foldable bag material formed into a bag having at least one end with a corner, end closure means formed by said bag material and closing off said one end of the bag, a filling valve tube means extending within said end closure means at said one corner, said valve tube means having an inner end disposed within the interior of the bag, said tube means having an inner layer which is convertable from a normally inactive adhesive state to a state capable of sealing off the tube means, and a shut-off lip means of flexible material within said end closure means and projecting into the interior of the bag beyond the interior end of said tube means, said shut-off lip means being constructed to be responsive to the pressure of the filling material introduced into the interior of the bag to close off the interior opening of said tube means.

2. A bag according to claim 1 wherein said bag is a rose-bottom or block-bottom valve bag of paper or the like foldable material, said end closure means comprising lateral turn-overs and corner turn-ins, one of said corner turn-ins being at said one corner at which the tube means is disposed, said shut-off lip means extending into the interior of said bag beyond said one corner turn-in.

3. A bag according to claim 1, wherein said end closure means comprises lateral turn-overs and corner turn-ins, said lateral turn-overs having generally parallel fold lines, said shut-off lip means comprising insert sheet means, and adhesive means securing said insert sheet means to said lateraL turn-overs and to said corner turn-in at said one corner.

4. A bag according to claim 3, wherein said insert sheet means has folded-over side edge portions parallel to said fold lines of said lateral turn-overs and incorporated within said lateral turn-overs juxtaposed to said lateral turn-over fold lines.

5. A bag according to claim 4, wherein said adhesive means secures said folded-over side edge portions of said insert sheet means to said lateral turn-overs.

6. A bag according to claim 3, wherein said insert sheet means is disposed between said lateral turn-overs and said corner turn-ins at said one corner, said adhesive means securing said insert sheet means to said corner turn-in at said one corner.

7. A bag according to claim 3, wherein said insert sheet means comprises two folded-over sections, said tube means being disposed between said two folded-over sections.

8. A bag according to claim 3, wherein said adhesive means secures said tube means to said insert sheet means.

9. A bag according to claim 3, wherein said tube means is disposed between said insert sheet means and said lateral turn-overs, said adhesive means securing said tube means to said insert sheet means and securing said tube means to said lateral turn-overs.

10. A bag according to claim 3, wherein said insert sheet means comprises an insert sheet having two sections which define a closed folded edge facing the outside of the bag and an open folded edge facing the interior of the bag.

11. A bag according to claim 10, wherein said adhesive means secures one of said sections to said tube means and the other section to said corner turn-in at said one corner.

12. A bag according to claim 10, wherein said open folded edge opens up into the interior of the bag to form a pocket which receives the filling matarial introduced into the bag.

13. A bag according to claim 3, wherein said end closure means comprises lateral turn-overs and corner turn-ins, said lateral turn-overs having generally parallel fold lines, said shut-off lip means comprising insert sheet means, and adhesive means securing said insert sheet means to said tube means.

14. A bag according to claim 13, wherein said insert sheet means comprises a single sheet of material.

15. A bag according to claim 13, wherein said insert sheet means comprises two sheets of material.

16. A bag according to claim 15, wherein each of said two sheets of material extend into the interior of the bag beyond the interior end of the tube means, one of said sheets extending further into the interior of the bag beyond the exterior end of the tube means than said other sheet.

17. A bag according to claim 16, wherein each of said two sheets of material has a folded edge, with the folded edge of said one sheet being disposed within the folded edge of said other sheet.

18. A bag according to claim 17, wherein each of said folded edges has a closed edge facing the outside of the bag and an open edge facing the interior of the bag.

19. A bag according to claim 18, wherein portions of said two sheets form a pocket therebetween which receives the filling material introduced into the bag.

20. A bag according to claim 16, wherein said one sheet forms a sealing-lip sheet and said other sheet forms a shut-off lip sheet, said sealing-lip sheet being made of a more flexible material than said shut-off lip sheet.

21. A bag according to claim 20, wherein said sealing-lip sheet is made of plastic film and said shut-off lip sheet is made of paper.

22. A bag according to claim 1, wherein said tube means has a width less than the width of the end of the bag.

23. A bag according to claim 2, wherein said two lateral turn-overs are provided with incisions at their end section adjoining the corner turn-in at said one corner, said incisions extending parallel to the axis of the bag to extend the lateral turn-overs in the longitudinal direction of said end closure means.

24. A bag according to claim 20, wherein said sealing lip sheet has folded-over side edge portions parallel to said fold lines of said lateral turn-overs, adhesive means securing said folded-over side edge portions of the sealing lip sheet to said lateral turn-overs in regions thereof extending beyond the shut-off lip sheet.

* * * * *